US005526854A

United States Patent [19]

Unger

[11] Patent Number: 5,526,854

[45] Date of Patent: Jun. 18, 1996

[54] THROUGH THE DOOR WATER AND ICE DISPENSER

[75] Inventor: Larry E. Unger, Southside, Ala.

[73] Assignee: White Consolidated Industries, Inc., Cleveland, Ohio

[21] Appl. No.: 424,041

[22] Filed: Apr. 19, 1995

Related U.S. Application Data

[62] Division of Ser. No. 253,707, Jun. 3, 1994, Pat. No. 5,442,933, which is a division of Ser. No. 969,995, Nov. 2, 1992, abandoned.

[51] Int. Cl.[6] ..... B65B 1/04; B65B 3/00

[52] U.S. Cl. ..... 141/351; 141/362; 141/98; 222/146.5; 222/146.6

[58] Field of Search ..... 141/351, 360, 141/361, 362, 98; 222/505, 146.6, 129.1, 181.1, 181.2, 181.3, 185.1; 62/337, 338, 339; 200/332, 547, 335

[56] References Cited

U.S. PATENT DOCUMENTS

| | | | |
|---|---|---|---|
| 3,341,065 | 9/1967 | Schuldt et al. | 141/362 |
| 4,084,725 | 4/1978 | Buchser | 62/344 |
| 4,176,527 | 12/1979 | Linstromberg et al. | 62/320 |
| 4,555,049 | 11/1985 | Mawby et al. | 222/146.6 |
| 4,627,556 | 12/1986 | Brooks | 222/146.6 |
| 4,800,935 | 1/1989 | Buchser et al. | 141/362 |
| 4,942,979 | 7/1990 | Linstromberg et al. | 62/340 |
| 4,972,999 | 11/1990 | Grace | 62/320 |
| 5,033,273 | 7/1991 | Buchser et al. | 62/320 |
| 5,050,777 | 9/1991 | Buchser | 62/344 |
| 5,056,688 | 10/1991 | Goetz et al. | 62/320 |
| 5,077,985 | 1/1992 | Buchser et al. | 62/344 |
| 5,224,589 | 7/1993 | Karakama et al. | 200/335 |
| 5,350,893 | 9/1994 | Yamauchi et al. | 200/547 |

OTHER PUBLICATIONS

DMC Design & Manufacturing Corporation, Electro–Thermal Actuators (Advertisement, dated Jan. 27, 1992).

*Primary Examiner*—Henry J. Recla
*Assistant Examiner*—Steven O. Douglas
*Attorney, Agent, or Firm*—Pearne, Gordon, McCoy & Granger

[57] ABSTRACT

A through-the-door ice and cold water dispenser for domestic refrigeration units provides a housing positioned within a recess formed in the door insulation. The dispenser provides an actuation cradle formed with a smoothly curved concave surface in combination with a switch operating system which requires low forces for operation so that the dispenser can be actuated by fragile containers, such as polystyrene foam cups. An insulated damper door is closed when the dispenser is not operating to prevent heat transfer into the freezer compartment where the ice is produced and stored. A heater positioned against the damper door operates to release the damper door should it become frozen in the closed position. All of the controls for the dispenser are located in the upper portion of the housing and are accessible with a minimum amount of disassembly when service or maintenance-is required. A spill tray is located in the bottom of the dispenser recess to contain and retain spilled water and melted ice water. The spill tray is easily removable for dumping.

3 Claims, 7 Drawing Sheets

Fig. 1A
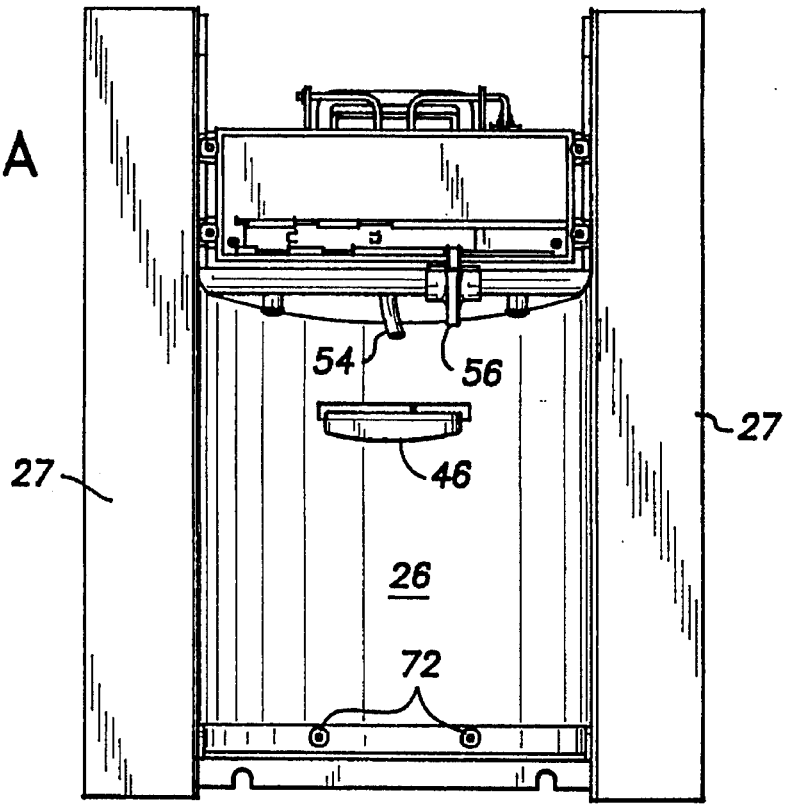
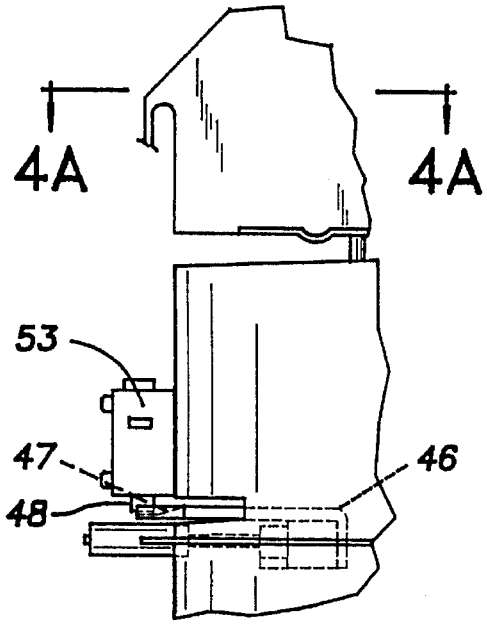
Fig. 4
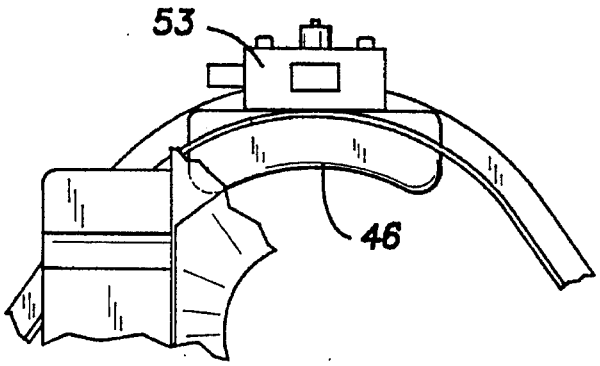
Fig. 4A

Fig. 6
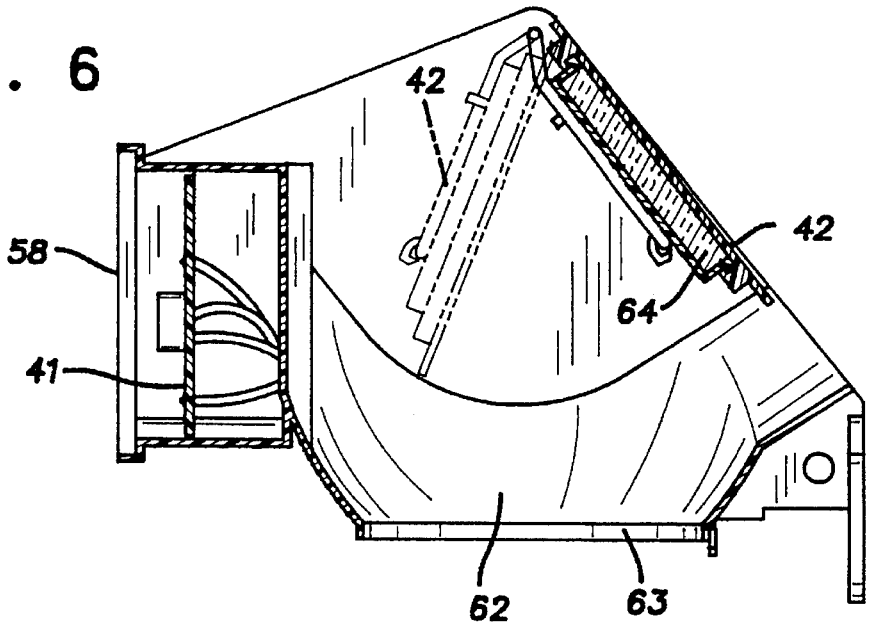
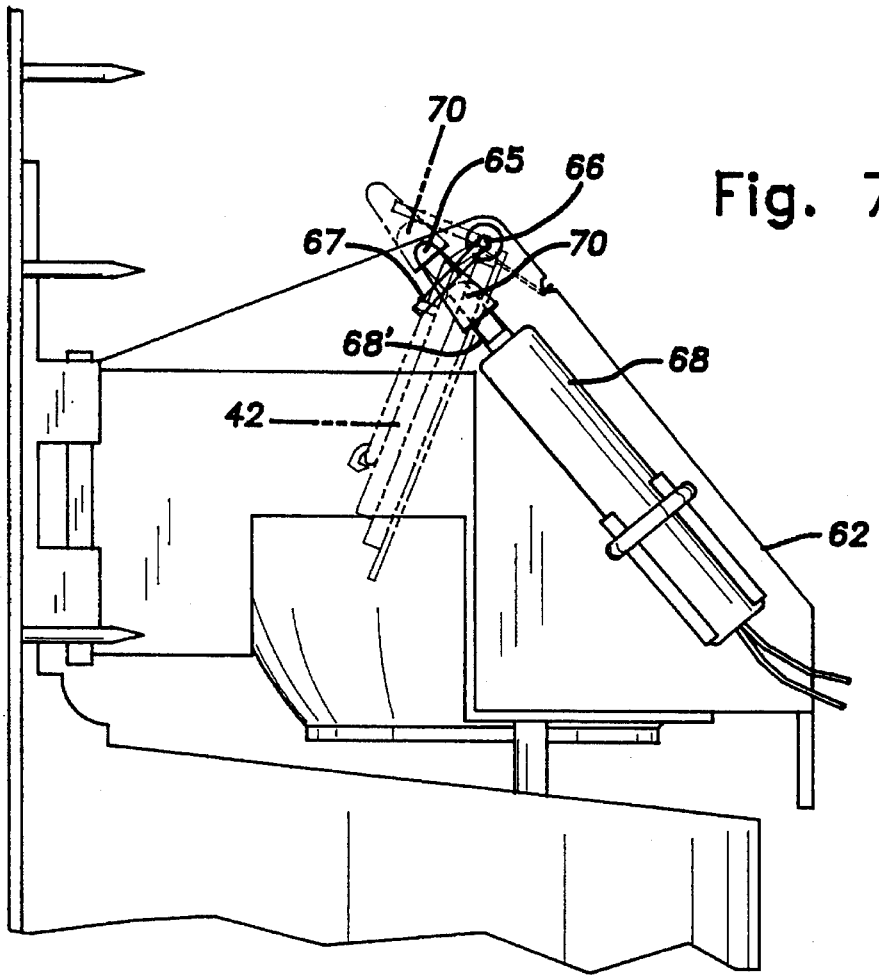
Fig. 7

Fig. 10
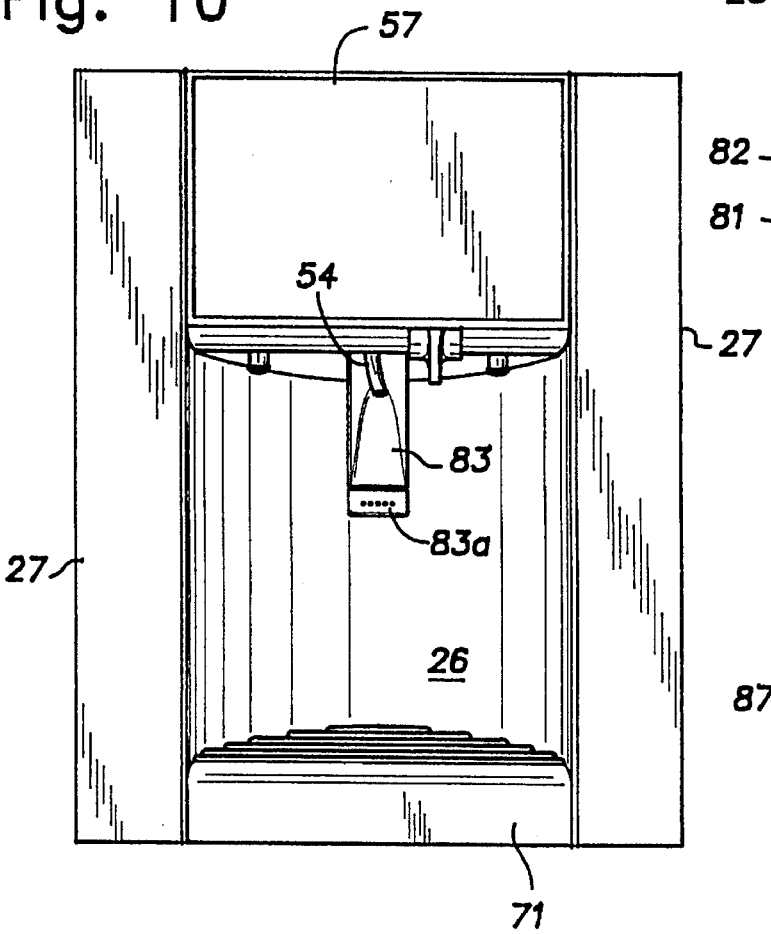
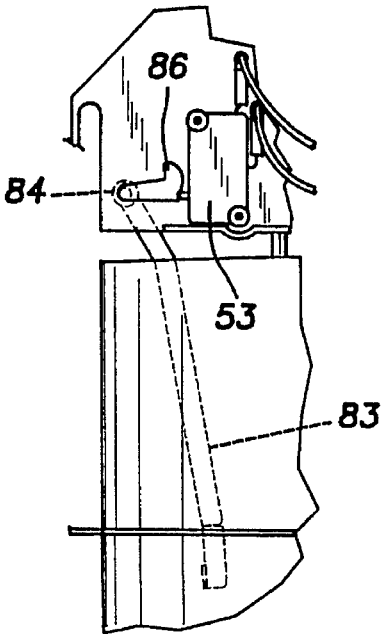
Fig. 11
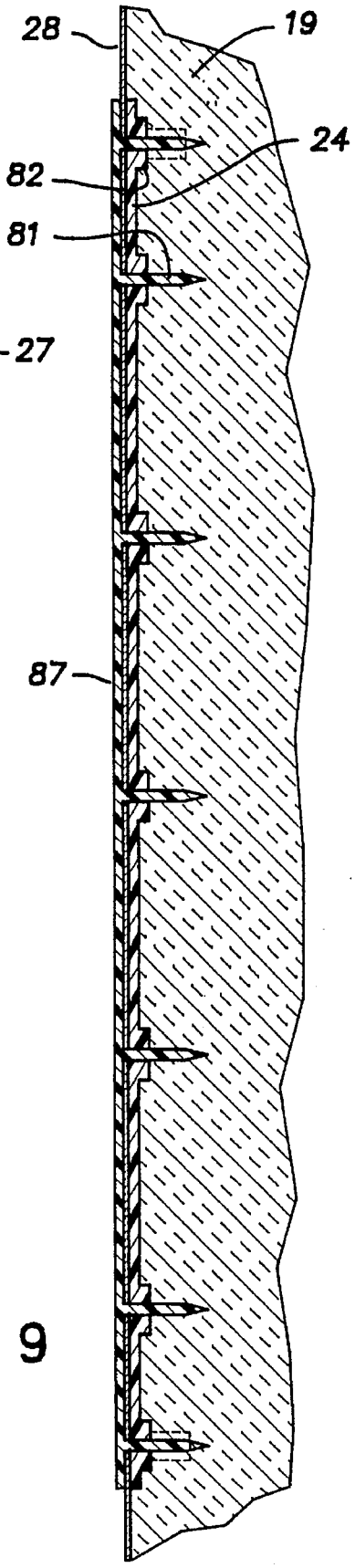
Fig. 9

THROUGH THE DOOR WATER AND ICE DISPENSER

This is a division of application Ser. No. 08/253,707, filed Jun. 3, 1994, now U.S. Pat. No. 5,442,933, which is a division of application Ser. No. 07/969,995, filed Nov. 2, 1992, now abandoned.

BACKGROUND OF THE INVENTION

This invention relates to ice and cold water dispensers for domestic refrigeration units, and more particularly, to a novel and improved through-the-door dispensing system for such units.

Prior Art

Typical through-the-door ice dispensing systems for domestic refrigeration units provide an automatic ice maker located in a freezer section of the unit. Such ice makers produce discreet pieces of ice which are referred to herein as "ice cubes" even though they may have a crescent or other shape which is not a cube shape. Such units include a storage bin which receives the ice cubes from the ice maker where the cubes are stored until used. A dispenser system is provided to deliver the cubes when required by the user.

In some such dispensing systems, means are provided to move the cubes from the bin and deliver uncrushed ice cubes to a glass held by the user. Examples of such systems are illustrated in the U.S. Pat. Nos. 4,084,725; 4,942,979 and 5,033,273.

In other instances, the dispensing system includes a crusher which operates to crush the cubes and deliver the ice as finely divided particles. Further, in some instances, the dispenser can be selectively operated to deliver crushed ice or uncrushed cubes. Examples of such systems are illustrated in the U.S. Pat. Nos. 4,176,527; 4,627,556; 4,972,999; 5,050,777 and 5,056,688. In addition, some units can be selectively operated to dispense cold water.

Typically, the dispenser provides an actuator or cradle against which a cup, glass or other container into which the ice or water is to be deposited is pressed to initiate the operation of dispensing. When the actuator cradle is released by removal of the glass, etc., the unit shuts off, and the dispensing is terminated. A passage normally connects the freezing compartment and the external portion where ice is delivered. A closure or door usually closes this passage when the dispenser is not operating to minimize heat transfer through the passage. When dispensing is required, the passage is opened to permit passage of ice. The U.S. Pat. Nos. 4,555,049; 5,033,273 and 5,077,985 illustrate such systems.

SUMMARY OF THE INVENTION

There are a number of important aspects to the present invention. In accordance with one important aspect of this invention, a dispensing actuator is provided which can be operated by fragile containers, such as typical polystyrene foam cups. Such actuator is shaped provided with a smoothly curved concave surface proportioned so that a substantial area of contact is provided with a polystyrene foam cup to prevent cracking or puncturing of the cup. In addition, the mechanism connecting the actuator or cradle with the switching system that energizes the dispenser is constructed so that the force required to commence the dispensing operation is quite low. Two embodiments are illustrated. One embodiment provides an actuator which is mounted for reciprocating movement. The other embodiment utilizes a pivoted actuator. Both embodiments provide actuators which operate a switch, rather than some mechanical element of the system. Therefore, operating forces are low.

In accordance with another important aspect of this invention, an improved door is provided between the cold or freezer portion of the system and the non-frozen portion of the dispenser to prevent substantial heat transfer to the freezer portion. Such door is positioned and structured to provide an efficient thermal barrier. An electric heater is positioned adjacent to the door so that in the event that the door becomes frozen in the closed position, sufficient heat is supplied to release the door and allow it to open.

In accordance with another aspect of this invention, a single actuator is used to initiate delivery of uncrushed ice, crushed ice and cold water.

In accordance with still another aspect of the present invention, a dispensing system is provided in which all of the various controls and operators of the system are accessible from the exterior so that it is not necessary to remove the entire unit in order to provide service for the unit.

It is still another important aspect of this invention to provide a removable spill tray which retains and contains significant amounts of spill to prevent melting ice or spilled water from escaping on to the floor adjacent to the unit. Such tray is easily removable if significant amounts of spill have occurred to allow it to be emptied. Further, such tray, when removed, provides access to fasteners utilized to mount the dispenser in the door.

In both illustrated embodiments, the dispenser is mounted in an insulated recess formed in the door of a side-by-side refrigerator/freezer unit. It should be understood, however, that the unit can also be installed in refrigerators having an upper freezer compartment and a lower food storage compartment.

The through-the-door dispensing units are mounted in insulated recesses formed in the door and provide a forward face flush with the exterior surface of the door. The dispensers provide a passage connected to a source of ice cubes and/or crushed ice. Such passage is closed by a pivoted damper door when the unit is not in operation dispensing ice.

All of the portions of the unit which can require service during the life of the unit are accessible from the front of the unit with the electrical circuit of the control being accessible with only minor disassembly. The mechanical components of the control and actuating system require some additional disassembly but are conveniently accessible for repair or replacement.

These and other aspects of this invention are illustrated in the accompanying drawings and are more fully described in the following specification.

BRIEF DESCRIPTION OF THE DRAWINGS

FIG. 1A is a fragmentary view of the first embodiment of the dispensing unit with the spill tray and outer cover removed;

FIG. 4 is a fragmentary view illustrating the cradle or actuator and its connection to the operating switch which initiates the operation of the dispenser;

FIG. 4A is a broken fragmentary section taken generally along 4A—4A of FIG. 4;

FIG. 6 is a fragmentary side elevation in cross-section illustrating the damper door which closes the passage connecting the interior and exterior portions of the system to prevent heat transfer along the connecting passage when the unit is not dispensing;

FIG. 7 is a side elevation of the upper subassembly of the exterior portion of the dispensing unit illustrating the damper door actuator which operates to open the door when dispensing operation is required;

FIG. 9 is a fragmentary cross-section of the border portion having spike-like locating projections which are pressed into the insulation to position the unit and assist mounting the unit;

FIG. 10 is a front elevation of the second embodiment having a pivoted actuator; and FIG. 11 is a fragmentary side elevation illustrating the pivoted mounting of the actuator and the structure of the switch operator of such actuator.

DETAILED DESCRIPTION OF THE DRAWINGS

Figure 1:
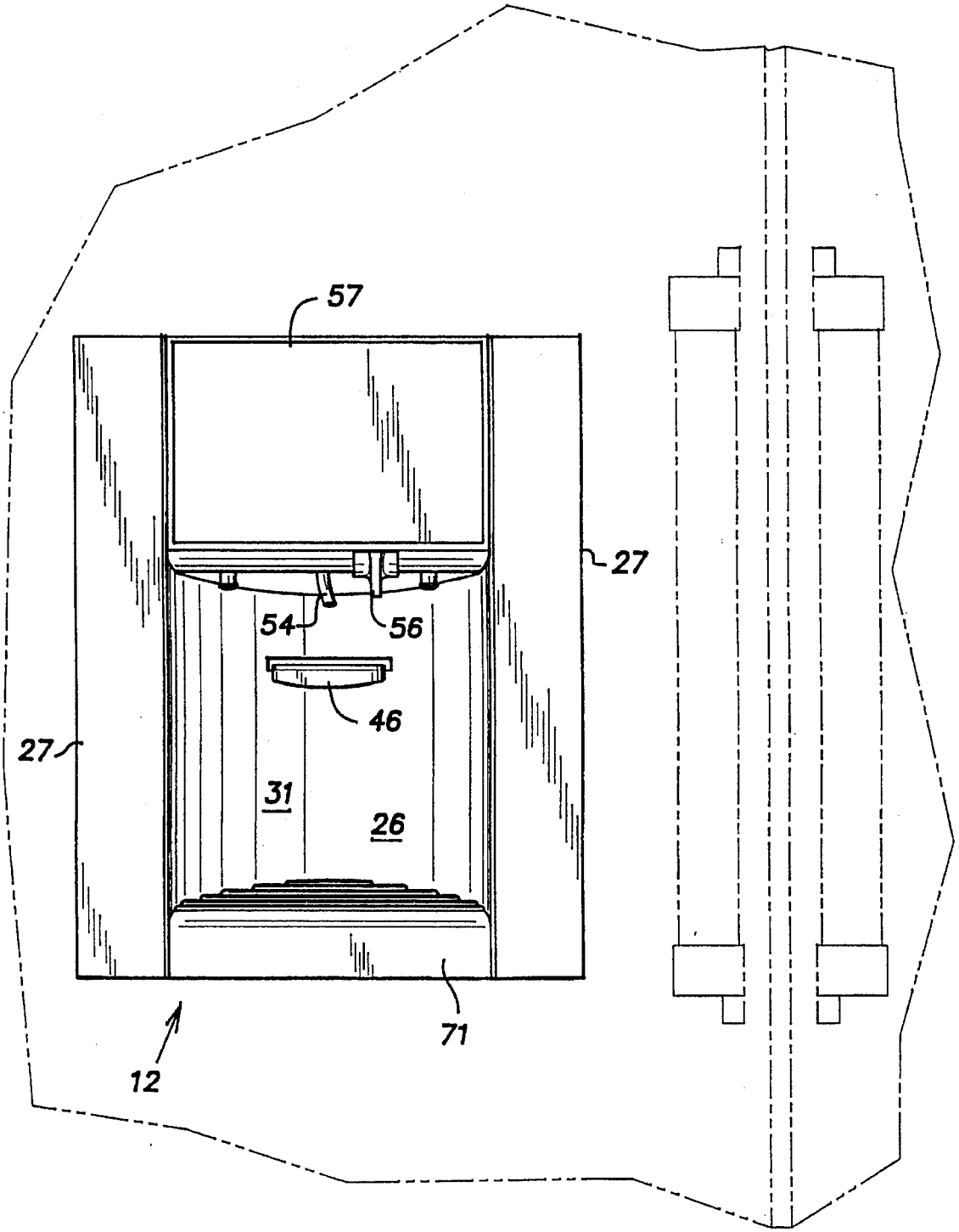
FIG. 1 illustrates the dispensing unit, in accordance with the present invention, mounted in the door of the side-by-side domestic refrigerator/freezer unit.
Figure 2:
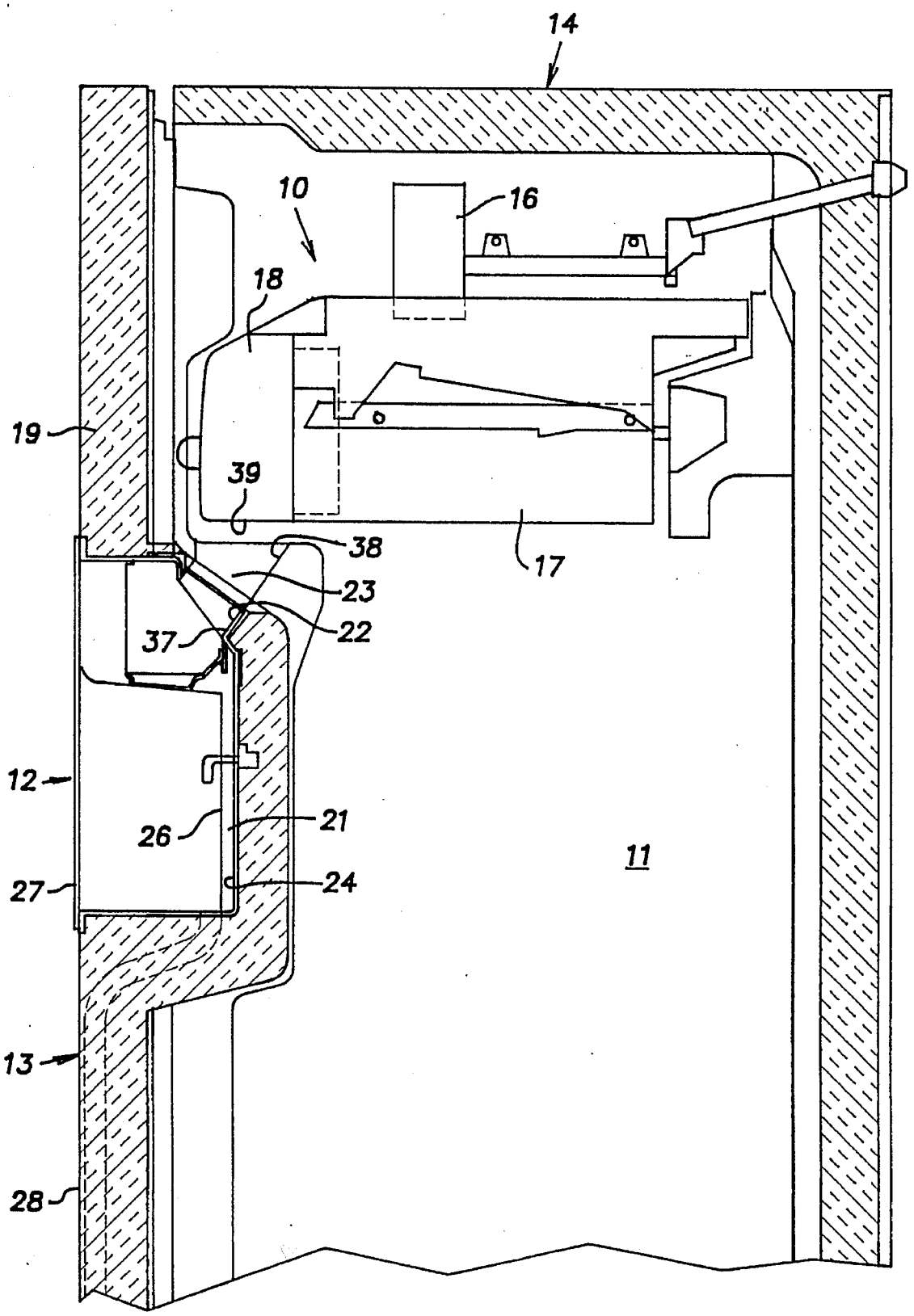
FIG. 2 is a vertical cross-section of the first embodiment illustrating the overall system, including the internal apparatus mounted within the freezer chamber and the external dispensing unit mounted in the freezer door.

FIGS. 1 and 2 illustrate the general arrangement of the dispensing unit, in accordance with the present invention. As best illustrated in FIG. 2, the unit includes an internal assembly 10 located within a freezer compartment 11 and an external dispensing assembly 12 mounted within a recess formed in an insulated door 13. The door is pivoted on the insulated cabinet 14 for movement between the closed position illustrated and an open position to obtain access to the freezer compartment.

The internal assembly includes an automatic ice maker 16 and a storage bin 17. Located on the front of the storage bin 17 is a crusher unit 18 which, in the illustrated embodiment, is capable of delivering crushed or uncrushed ice cubes. The internal assembly 10 is the subject matter of a U.S. Pat. No. 5,359,795, issued Nov. 1, 1994. Reference may be made to that U.S. Letters Patent for a more detailed description of the structure and operation of the internal assembly.

The door 13 is insulated by foamed in place insulation. Such insulation is formed with a recess 21 that receives the external dispensing assembly 12 and completely surrounds such assembly, except for an opening 22 surrounding a passage 23 connecting the internal assembly 10 with the external dispensing assembly 12. This recess is formed around a liner 24 positioned within the mold during the foaming of the insulation 19. The liner 24 provides a cylindrical projection 37 which is inclined rearwardly and upwardly to form part of the passage 23. With this structure, a very efficient insulation wall extends in an uninterrupted manner around substantially the entire recess 21 and provides an improved thermal barrier. The manner in which the insulation is formed and its structure is described in detail in the U.S. Pat. No. 5,359,795, issued Nov. 1, 1994.

Figure 3:
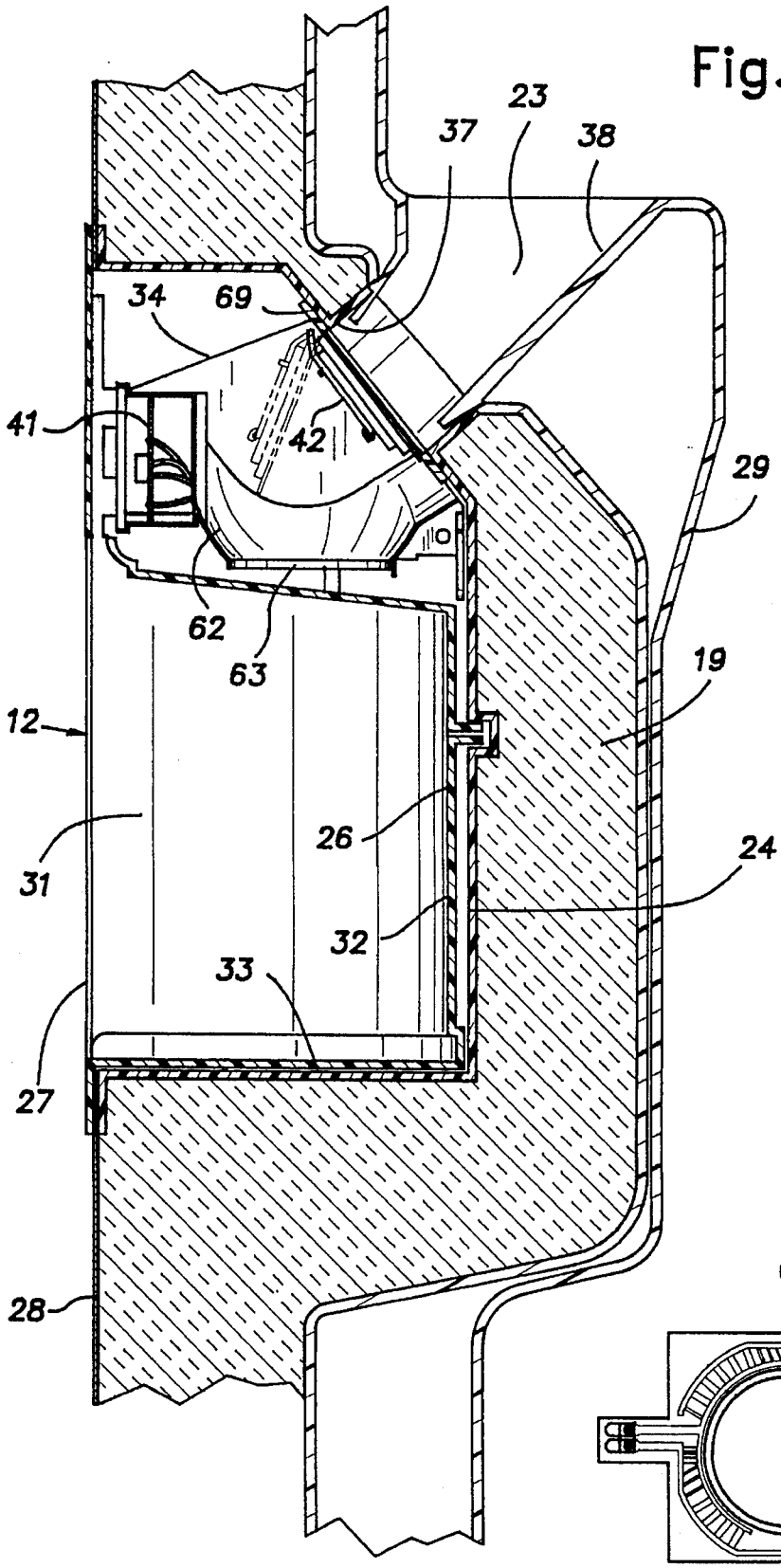
FIG. 3 is an enlarged cross-section of the dispensing system with parts removed for purposes of illustration.

As best illustrated in FIG. 3, the external dispensing assembly includes a molded plastic housing 26 which is mounted within the recess defined by the liner 24. The housing 26 includes two vertically extending side border portions 27 (best illustrated in FIG. 1) which extend outwardly against the sheet metal face 28 of the door. An inner liner 29 formed of molded plastic is mounted on the inside of the door and is formed with lateral shelves and the like (not illustrated) on which food items may be stored.

The housing 26 defines a dispenser recess 31 in which the various containers, cups or glasses are positioned during the dispensing operation. This dispenser recess 31 is defined on its sides by a curved, vertically extending wall 32 and along its bottom by a bottom wall 33. The dispenser recess 31 does not extend the full height of the recess defined by the liner 24, even though the border members 27 do extend to such full height.

Located in the upper portion of the recess formed by the liner 24 is a control assembly 34. The inner liner 29 is also formed with a cylindrical projection 38 which telescopes with the cylindrical projection 37 and cooperates therewith to form the passage 23. The upper end of the cylindrical projection 38 is located immediately below the discharge 39 of the internal assembly 10 so that when dispensing occurs, the ice cubes or crushed ice pass through the discharge 39 into the passage 23 for delivery to the external dispensing assembly 12.

The control assembly 34 also includes an electrical circuit board 41 on which are mounted the various switches for controlling the operation of the dispenser and a damper door 42. The damper door is pivoted for movement between a closed position, illustrated in FIG. 3 in full line, and an open position, illustrated in phantom. The door position is controlled by an actuator, described in detail below, so as to maintain the door in the closed position when the dispenser is not operating. This minimizes the heat transfer through the passage 23 so that the operating efficiency of the overall unit is not degraded to any material extent.

Referring to FIGS. 1; 1A; 4 and 4A, the dispenser unit provides an actuator cradle 46 mounted for movement in a horizontal direction between an extended position illustrated, and an operative position rearwardly therefrom. The rearward end of the cradle is provided with a cam ramp 47 (illustrated in FIG. 4) engaged by the end of a switch operator 48 of a switch 53. When the cradle is moved rearwardly, the cam ramp 47 moves rearwardly under the switch operator 48 to close the switch 53. Closing of the switch 53 initiates the dispensing operation.

As best illustrated in FIG. 4A, the cradle 46 is formed with a concave forward face which is smoothly curved for engagement with containers in which ice or water is to be dispensed. The cradle is shaped to minimize localized stresses on a polystyrene foam cup, or any other container, and the switch operating mechanism connecting the cradle to the microswitch 53 requires sufficiently low force for operation so that even fragile containers, such as polystyrene foam cups, can be used to actuate the dispenser, in accordance with the present invention.

Referring to FIG. 1, the first illustrated embodiment of this invention is operable to selectively dispense chilled water through a tube 54 and crushed or uncrushed ice, as the user desires. A selector 56 is laterally slidable to three discreet positions. In one position, the dispenser operates to dispense uncrushed ice cubes. In a second position of the selector 56, crushed ice is dispensed. In a third position of the selector 56, cold or chilled water is dispensed. Such water is delivered to the dispenser by a tube which extends up along the door insulation and open through the bottom opening 63.

Figure 5:
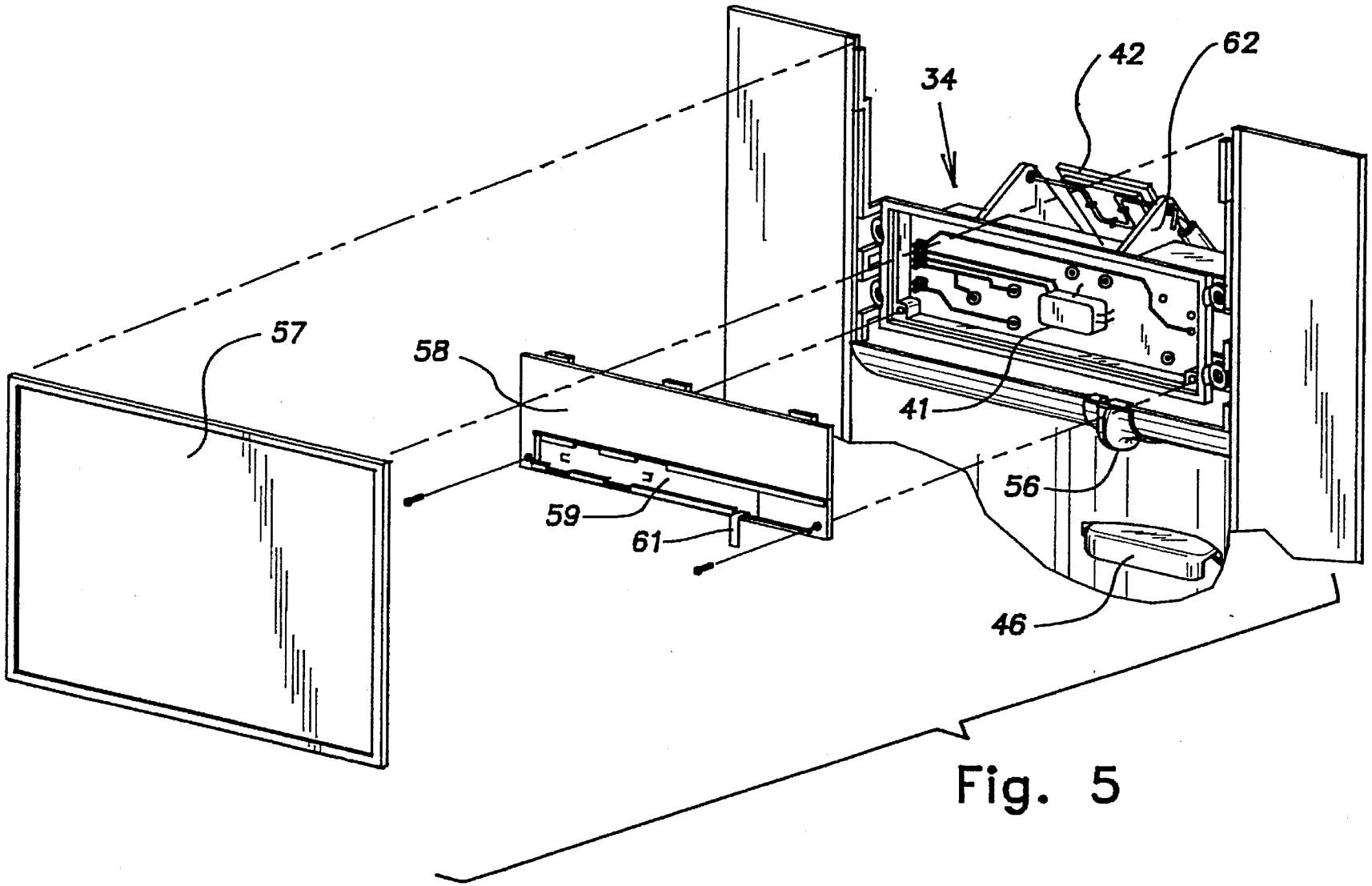
FIG. 5 is a fragmentary exploded view illustrating the manner in which access can be obtained to the electrical control system without substantial disassembly of the unit for service or repair operations.

Referring to FIGS. 1A and 5, the upper portion of the dispenser above the selector 56 is enclosed behind a removable cover panel 57. When access to the control assembly 34 is required, the panel 57 is removed.

Immediately behind the cover panel 57 is a removable circuit board cover 58 which covers the circuit board 41. Mounted on the cover 58 is a slidable switch operator 59 having a depending tongue 61 which connects with the selector 56 when the unit is assembled. This slidable switch operator moves back and forth between the three operated positions in response to movement of the selector 56 and operates switches on the circuit board to control the operation of the unit and cause the desired dispensing operation. As best illustrated in FIG. 5, removal of the cover panel 57 provides access to the circuit board cover 58. Further, removal of the board cover 58 provides complete access to the circuit board. Therefore, it is a simple matter when service or repairs are required to access the circuit board itself.

The circuit board itself is mounted on a control assembly housing 62 on which the damper door 42 is mounted and which is removably mounted in the Upper portion of the liner 24. This control assembly housing is secured and positioned during normal operation by fasteners which are accessible when the panel 57 is removed.

Referring now to FIGS. 6 and 7, the control assembly housing 62 is provided with a modified funnel shape so that ice entering the housing 62 through the passage 23 (while the damper door 42 is in the open position illustrated in phantom) is directed through a bottom opening 63 immediately above the container held against the cradle 46. As illustrated in FIG. 6, the door is provided with insulation 64 to resist heat transfer through the passage when the door is in the closed position.

Referring to FIG. 7, the door 42 is pivoted at 66 and provides an arm 67 fitting between the two sides 65 of a yoke 70 mounted on the piston 68' of a door operator 68. This operator is electrically operated, and when the piston 68' extends, the arm 67 pivots and opens the door 42. When electrically energized, fluid within the actuator is caused to vaporize and extend the piston 68' against an internal spring to the phantom position. When the actuator is de-energized, the vapor commences to cool, and after a delay, the internal spring moves the piston back to its retracted position causing the damper door 42 to return to its closed position. Since there is a delay in the closing operation after the dispenser is de-actuated by release of the cradle 46, sufficient time is allowed to permit any ice, crushed or uncrushed, to clear the passage. The illustrated actuator is manufactured by Design and Manufacturing Corporation, located at 4399 Hamann Parkway, Willoughby, Ohio, under the trade name "Electro-Thermal Actuators".

It is also possible to operate the door by the use of an electromagnetic solenoid. When the door is operated by a solenoid, a damper system is provided to delay the closing of the damper door 42 to allow ice to clear the passage.

Figure 8:
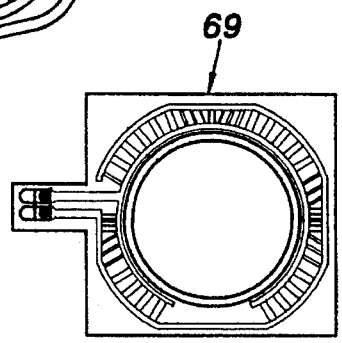
FIG. 8 is a fragmentary face view of the electric heater which operates to release the damper door in the event it becomes frozen in the closed position.

The damper door closes against the liner 24 immediately adjacent to the cylindrical projection 37. Consequently the damper door is, in effect, along the outer surface of the insulation 19. Further, since the door itself is insulated, it functions efficiently to prevent heat transfer through the passage. Because of its location, there is a tendency for the damper door to be frozen in the closed position. In order to avoid malfunction caused by such freezing, an electric heater 69 is mounted on the liner 24 around the opening for the passage. This heater is, therefore, against the door along the inner side of the liner. The heater is, preferably, shaped as illustrated in FIG. 8. In the event that the door is frozen in the closed position, the heater promptly causes melting and allows the door to open for proper dispensing operation.

A removable spill tray is also provided. This spill tray 71 is illustrated in FIG. 1 in its installed position. In FIG. 1A, it has been removed. The spill tray includes cross struts and an outer wall so that it can contain and retain substantial amounts of spilled water or melted ice. If it becomes full, it is easily pulled out of the mounted position and can be suitably dumped in the sink or the like. The spill tray, therefore, eliminates the tendency for water to run down the face of the refrigeration unit onto the floor.

In most instances, unless the dispenser is heavily used, it will hold the spillage until it evaporates so that it does not have to be removed and emptied. The spill tray provides a dual function of retaining any spillage. It also provides a finished appearance to the bottom of the dispensing system. When installed, it covers mounting fasteners 72 for the lower housing 26.

As best illustrated in FIG. 9, the border portions 27 are formed with spike-like locating projections 81 which are pressed through openings formed in the projections 82 formed in the liner 24 and into the insulation 19 of the door. These spike-like projections serve to automatically position the dispensing unit in the proper position with respect to the liner 24 during the installation of the unit. Preferably, the spike-like projections form a tight fit with the openings in the projections 82 in the liner 24 for accurate positioning of the unit. Also, they assist in the full mounting of the unit. In addition, they function to ensure that the border portions 27 fit flat against the face of the door, even if a degree of warpage does occur.

FIGS. 10 and 11 illustrate a second embodiment in which an actuator 83 is mounted for pivotal movement, rather than reciprocating movement, of the actuator 46 of the first embodiment. The actuator 83 is pivoted at 84 and is provided with a switch operating arm 86 which operates a microswitch 53 for initiating the operation of dispensing. Here again, since the actuator 83 merely operates an electrical switch rather than some mechanical component of the system, very low forces are required to pivot the actuator back and initiate the dispensing operation.

The lower end of the actuator 83 is provided with a soft rubber extension 83A which tends to cushion a container pressed against the actuator for operation of the dispenser. This further ensures that even fragile containers can be used to initiate the dispensing operation.

In accordance with the present invention, a relatively simple structure, formed primarily of molded plastic parts, is mounted in a recess formed in the door of a refrigeration unit. It provides an actuator cradle which operates with sufficiently low forces and is shaped to permit the initiation of the dispensing operation, even by relatively fragile polystyrene foam cups. It provides a removable spill tray to prevent any spillage from leaking down onto the floor adjacent to the refrigeration unit. The various controls are easily accessible to allow service of the various operating components of the system without removal of the entire unit. Further, an insulated damper door closes the passage through which ice enters the unit to minimize thermal transfer through the connecting passage. Finally, an electric heater is provided to release the door in the event that it becomes frozen in the closed position.

Although preferred embodiments of this invention have been shown and described, it should be understood that various modifications and rearrangements of the parts may be resorted to without departing from the scope of the invention as disclosed and claimed herein.

What is claimed is:

1. A through-the-door ice dispenser comprising a domestic refrigeration unit having at least one door to provide access to the interior of said unit, a freezer compartment within said interior of said unit having a source of ice, said door providing a first recess insulated from said interior and providing an opening in communication with said freezer compartment, a dispenser assembly mounted in said recess and providing a forward extremity substantially flush with the outer surface of said door, said dispenser assembly providing a second recess within said first recess sized to allow insertion of a container to receive ice, a passage connecting said source within said freezer compartment and said second recess through said opening, a closure in said passage movable between open and closed positions, an electrical actuator means operable to move said closure, an actuator located within said second recess formed with a smooth forward surface, said actuator being moveable to an operative position upon engagement with said container and connected to operate an electrical switch which causes said dispenser to energize said electrical actuator means both to open said closure and dispense ice into said container and to delay the closing of said closure until said passage is substantially free of ice, said actuator providing sufficient area contact with a polystyrene foam cup and being moveable to operative positions with forces sufficiently low to allow operation by a polystyrene foam cup.

2. A through-the-door ice dispenser as set forth in claim 1, wherein said actuator is linearly moveable from a forward "off" position to a rearward "operative" position, said actuator providing a camming ramp for operating said switch.

3. A through-the-door ice dispenser as set forth in claim 1, wherein said actuator is pivotally mounted and provides an arm operating said switch.

* * * * *